US007066326B2

(12) United States Patent
Li et al.

(10) Patent No.: US 7,066,326 B2
(45) Date of Patent: Jun. 27, 2006

(54) FIXTURE BOX FOR ELECTRICAL FANS AND CONNECTORS THEREFOR

(75) Inventors: Nien-Lun Li, Hsin-Chuang (TW); Chin-Yueh Chu, Hsin-Chuang (TW)

(73) Assignee: Datech Technology Co., Ltd., Taipei Hsien (TW)

( * ) Notice: Subject to any disclaimer, the term of this patent is extended or adjusted under 35 U.S.C. 154(b) by 119 days.

(21) Appl. No.: 10/793,827

(22) Filed: Mar. 8, 2004

(65) Prior Publication Data

US 2005/0194274 A1 Sep. 8, 2005

(51) Int. Cl.
*B65D 85/00* (2006.01)
*B65D 1/24* (2006.01)

(52) U.S. Cl. ..... 206/320; 220/507; 220/552

(58) Field of Classification Search ..... 206/320, 206/589, 593, 561; 220/507, 533, 552
See application file for complete search history.

(56) References Cited

U.S. PATENT DOCUMENTS

| | | | | | |
|---|---|---|---|---|---|
| 1,895,249 | A | * | 1/1933 | Juffa | 206/589 |
| RE19,525 | E | * | 4/1935 | Juffa | 220/589 |
| 2,405,216 | A | * | 8/1946 | Josh | 220/507 |
| 2,688,399 | A | * | 9/1954 | Swiderski | 206/320 |
| 3,656,650 | A | * | 4/1972 | Frater | 220/533 |
| 4,602,715 | A | * | 7/1986 | Sarver et al. | 220/533 |
| 5,232,090 | A | * | 8/1993 | Raab et al. | 206/320 |

* cited by examiner

*Primary Examiner*—Bryon P. Gehman
(74) *Attorney, Agent, or Firm*—Troxell Law Office, PLLC

(57) ABSTRACT

A box for an electric fan, which can include a fan body, a wire and a connector, generally includes a plurality of first boards, second boards, and connector boards within the box. These boards can form respective containers for the fan body and respective containers for the connector. Desirably, each board of the plurality of second boards and the plurality of connector boards form respective fillisters. As such, at least one of the fillister of a second board and the fillister of a connector board can receive at least a portion of the wire of the electric fan.

10 Claims, 3 Drawing Sheets

FIXTURE BOX FOR ELECTRICAL FANS AND CONNECTORS THEREFOR

FIELD OF THE INVENTION

The invention relates generally to an assembly and positioning fixture box. More particularly, the invention relates to a fixture box for electrical fans and connectors therefor for temporarily holding electrical fans and connectors in a preferred position to facilitate its moving, for avoiding breaking of electric wires and connectors induced by collision or incidentally hooking in delivery process.

DESCRIPTION OF THE RELATED ART

Generally, manufacturers of electric fan hope their finished products can be delivered to client in fully good condition for assuring quality of electric fan and goodwill of company. Unfortunately, phenomenon of breaking of connector which is coupled at the end of electric wire induced by collision in delivery process happens normally. Therefore, several different methods of solution are used by manufacturer to solve the problem.

One of the methods is by using a tray having several containers for depositing electric fan before delivery process. But productive cost of the method is expensive due to the trays are not recycled after used. Therefore, the method is not a better way although it is safety.

Other concerns related to the manufacture of electric fans use adhesive tape to adhere end of electric wire before depositing the electric fans into fixture box for avoiding breaking of connectors which is coupled at the end of electric wire induced by collision in delivery process. But the method is not convenient for clients as the adhesive tape have to take apart before use the electric fans. Thereby, problem of breaking of connectors of electric fans happens frequently due to over external force is used to remove tight adhesive tapes. Therefore, conventional techniques of fixture box for electrical fans and connectors therefor are not suitable to requirement in application.

SUMMARY OF THE INVENTION

One aspect of the present invention is to deposit body of electric fan into electric fan container, also deposit electric wire and connector of electric fan into connector container for avoiding problem of breaking of electric wire and connector induced by collision or incidentally hooking in delivery process.

For the above purpose, the invention relates to a fixture box for electrical fans and connectors therefor comprises of a body of fixture box formed by a plurality of electric fan containers and a connector container obtained in the electric fan container to forming two isolation containers. Therethrough, body of electric fan is deposited in the electric fan container, while electric wire and connector of electric fan are deposited in connector container for avoiding problem of breaking of electric wires and connectors of electric fans induced by collision or incidentally hooking in delivery and moving process.

BRIEF DESCRIPTION OF THE INVENTION

Figure 1:
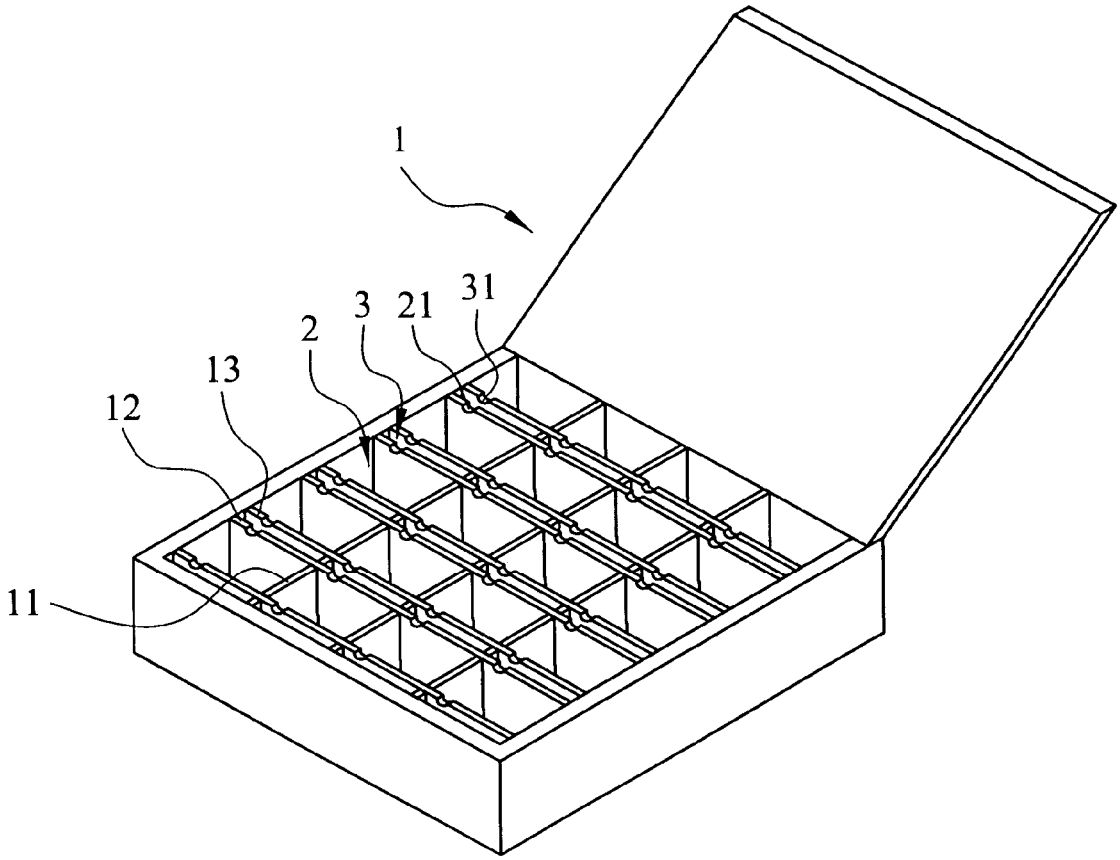
Figure 2:
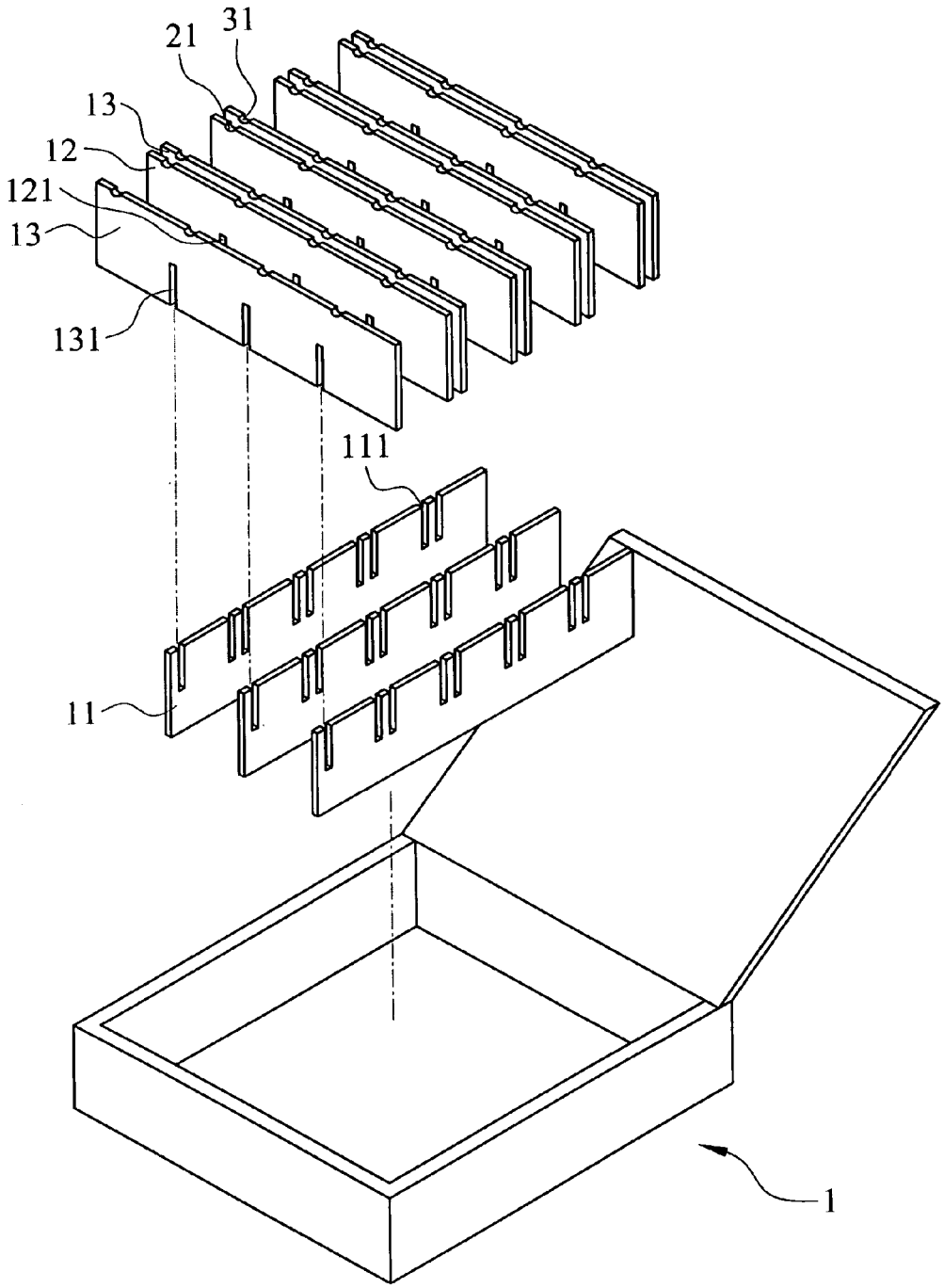
Figure 3:
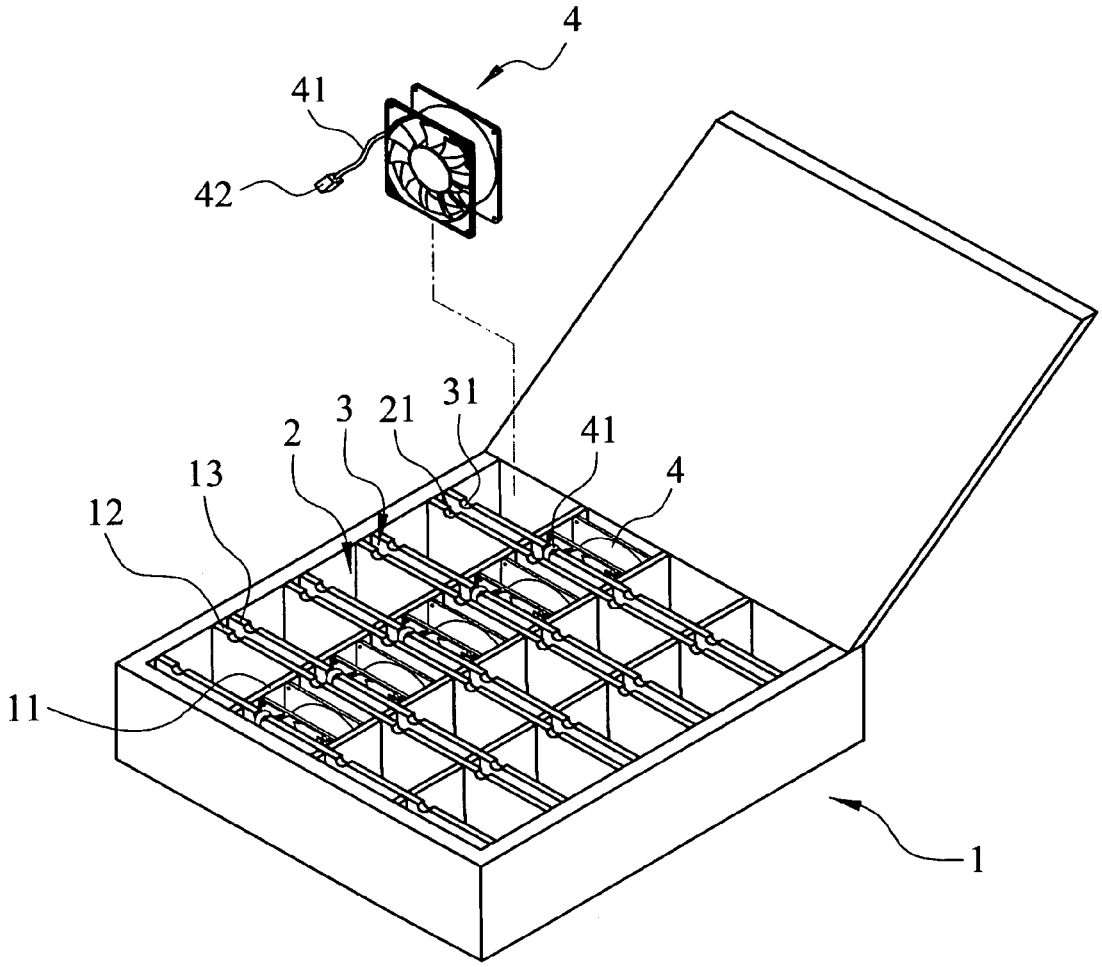

The present invention will be better understood from the following detailed description of preferred embodiments of the invention, taken in conjunction with the accompanying drawings, in which FIG. 1 is a perspective view of a fixture box according to the present invention;

FIG. 2 is an exploded view of a fixture box according to the present invention; and FIG. 3 is a perspective view showing the status on use according to the present invention.

DESCRIPTION OF THE PREFERRED EMBODIMENTS

The following descriptions of the preferred embodiments are provided to understand the features and the structures of the present invention. With reference to FIG. 1 through FIG. 3, FIG. 1 is a perspective view of a fixture box according to the present invention. FIG. 2 is an exploded view of a fixture box according to the present invention, while FIG. 3 is a perspective view showing the status on use according to the present invention.

As illustrated in the above figures, the present invention relates to a fixture box for electrical fans and connectors therefor comprises of a body of fixture box 1 which is formed by electric fan container 2 and connector container 3. Electric fan 4 can be deposit in the electric fan container 2, while electric wire 41 and connector 42 of electric fan 4 can be deposit in the connector container 3, for avoiding problem of breaking of electric wires 41 and connectors 42 of electric fan 4 induced by collision or incidentally hooking in delivery and moving process.

The body of fixture box 1 stated above is made of paper. As descriptions in details, a plurality of electric fan containers 2 in a body of fixture box 1 is formed by connection of first oriented boards 11 and second oriented boards 12. And then, a connector container 3 is obtained in the electric fan container 2 by using a connector board 13 to forming two isolation containers. The connector container 3 can be positioned at any side of electric fan container 2 which is selected from the group of front side, rear side, left side and right side, by depending on practical conditions. A plurality of slots 111, 121, 131 is formed respectively on first oriented boards 11, second oriented boards 12 and connector boards 13. By connection of the slots of the first oriented boards 11, second oriented boards 12 and connector boards 13, a plurality of electric fan containers 2 having two isolation containers is formed in the body of fixture box 1. The volume of the electric fan container 2 is greater than that of the connector container 3. Fillisters 21 and 31 are formed on the connector board and the second oriented board between the electric fan container 2 and the connector container 3. Therefore, a novel fixture box for electrical fans and connectors therefor as described above is completed.

FIG. 3 is a perspective view showing the status on use according to the present invention. As illustrated in FIG. 3, when the present invention is used to deposit electric fan 4 by users, firstly, electric fan 4 is deposited inside electric fan container 2 of the body of fixture box 1. Secondly, electric wire 41 and connector 42 of electric fan 4 are deposited inside connector container 3 of the body fixture box 1.

By the above means, electric fan 4 can be deposited separately with electric wire 41 and connector 42 of the electric fan 4 for avoiding breaking of connectors 42 of electric fan 4 induced by collision or incidentally hooking in delivery process. Moving of the electric fan 4 by users is by using fillisters 21 and 31 which are formed on the connector boards and the second oriented board between the electric fan container 2 and the connector container 3. Therethrough, holding both side of body of electric fan 4 by fingers, followed by an external force to take out body of the electric fan 4, simultaneously, electric wire 41 and connector 42 of electric fan 4 can be took out from connector container 3. Thereby, by the above means, problem of breaking of electric wire 41 and connectors 42 of electric fan 4 induced by incidentally hooking in moving process can be avoid. In addition, fillisters 21 and 31 can be used to hold electric wire 41.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed is:

1. A box for electric fans each comprising a fan body, a wire and a connector, comprising:

a plurality of first boards, a plurality of second boards, and a plurality of connector boards within the box wherein the plurality of second boards and the plurality of connector boards are oriented substantially parallel with respect to each other and oriented substantially perpendicular to the plurality of first boards to form a plurality of fan body containers each for a fan body and a plurality of connector containers each for a connector; and each board of the plurality of second boards and the plurality of connector boards defines a respective fillister extending between a fan body container and an adjacent connector container and wherein a fan body of a said electric fan is located in a fan body container and its corresponding connector is located in an adjacent connector container so that at least one fillister of said second boards and connector boards receives a portion of the wire of said electric fan.

2. The box according to claim 1, wherein the box is made of at least paper.

3. The box according to claim 1, wherein a volume of the container for the fan body is greater than a volume of the container for the connector.

4. The box according to claim 1, wherein the plurality of first boards, second boards, and connector boards are connected.

5. The box according to claim 4, wherein the boards form slots and making the connection comprises aligning and compressing the first board with respective slots with a slot in the second board and a slot in the connector board.

6. A box for electric fans each comprising a fan body, a wire and a connector, comprising:

a plurality of first boards, a plurality of second boards, and a plurality of connector boards within the box form respective containers for each fan body and respective containers for each connector; and each board of the plurality of second boards and the plurality of connector boards defines a respective fillister extending between a fan body container and an adjacent connector container and a fan body of a said electric fan is located in a fan body container and its corresponding connector is located in an adjacent connector container so that at least one fillister of said second boards and connector boards receives a portion of the wire of said electric fan.

7. The box according to claim 6, wherein the box is made of at least paper.

8. The box according to claim 6, wherein a volume of a container for the fan body is greater than a volume of a container for the connector.

9. The box according to claim 6, wherein the plurality of first boards, second boards, and connector boards are connected.

10. The box according to claim 9, wherein the boards form slots and making the connection comprises aligning and compressing the first board with respective slots with a slot in the second board and a slot in the connector board.

* * * * *